United States Patent [19]

Konishi et al.

[11] Patent Number: 4,831,308

[45] Date of Patent: May 16, 1989

[54] ION BEAM GUN WHEREIN THE NEEDLE EMITTER IS SURROUNDED BY A TUBULAR NOZZLE SO AS TO PRODUCE AN INCREASED ION BEAM

[75] Inventors: Morikazu Konishi; Masaaki Takizawa, both of Kanagawa, Japan

[73] Assignee: Sony Corporation, Tokyo, Japan

[21] Appl. No.: 101,131

[22] Filed: Sep. 25, 1987

[30] Foreign Application Priority Data

Sep. 25, 1986 [JP] Japan ..... 61-227350

[51] Int. Cl.[4] ..... H01J 33/02; H01J 17/26

[52] U.S. Cl. ..... 313/362.1; 313/363.1

[58] Field of Search ..... 313/362.1, 363.1, 230; 250/423 R, 423 F, 426, 427

[56] References Cited

U.S. PATENT DOCUMENTS 2,679,597 5/1954 Turner ..... 313/359.1 X
2,809,314 10/1957 Herb ..... 313/230 X
4,598,231 7/1986 Matsuda et al. ..... 313/363.1 X

*Primary Examiner*—David K. Moore
*Assistant Examiner*—K. Wieder
*Attorney, Agent, or Firm*—Hill, Van Santen, Steadman & Simpson

[57] ABSTRACT

An ion beam apparatus with an ion gun in which a gas to be ionized is supplied to the periphery of an emitter and a high voltage is applied between the emitter and an extractor so that the gas introduced to the vicinity of the emitter tip is ionized to generate an ion beam. The structure of the ion gun is formed so as to achieve a high ion current density of the ion beam as well as to prevent short-circuiting that may otherwise be caused by atmospheric electric discharge between the emitter and the extractor.

9 Claims, 6 Drawing Sheets

ION BEAM GUN WHEREIN THE NEEDLE EMITTER IS SURROUNDED BY A TUBULAR NOZZLE SO AS TO PRODUCE AN INCREASED ION BEAM

BACKGROUND OF THE INVENTION

1. Field of the Invention

The present invention relates to an ion beam apparatus for use in photolithography which directly exposes a photoresist formed on a semiconductor wafer, as well as in ion implantation, ion etching and so forth.

2. Description of the Prior Art

FIG. 3 schematically shows the structure of a typical ion beam apparatus. This apparatus is broadly divided into an ion gun a, a focusing lens system b and a deflecting electrode c. For example, the ion beam apparatus is employed to form a desired pattern on a sample with a generated ion beam and where the sample d which is the pattern is generally disposed on a support and a desired figure is drawn thereon by the use of an ion beam. The throughput in such operation is considerably affected by a probe current of the ion beam, and when it is required to increase the throughput by increasing the probe current, realization of a high luminance with a large ion current density is one of important requirements for the ion gun. In FIG. 3 are also shown an emitter 1', an extractor 2' and an aperture e.

FIG. 4 illustrates a conventional ion gun, which comprises a needle emitter 1 with a pointed tip having a radius of curvature of 500 to 1000 Å, and an extractor 2 which has a hole of 1 mm in diameter. The needle emitter 1 is attached to a fore end 10 of a refrigerator with an insulator 9. When a high voltage is applied to the needle emitter 1, a high-intensity electrical field is generated selectively at its tip to ionize atoms (molecules) of a gas such as helium which is delivered via a gas supply pipe 4 to fill the periphery of the emitter 1. (Normally the applied voltage ranges from 20 to 30 kV.)

The ions thus obtained form an ion beam which decrease radially from the tip of the emitter. In the ion beam generated at the emitter tip, the density of the atoms (molecules) existing in the vicinity of the emitter can be maintained high by cooling the emitter, so that it is possible to obtain an ion beam having a high current density.

The probe current of the focused ion beam is required to have a value of 10 to 100 pA in practical use. For satisfying such requirement, the gas pressure in the ion gun must be in the order of $10^{-3}$ Torr, because the relationship of FIG. 5 exists between the helium pressure and the ion current, which shows that the helium pressure must be raised to increase the ion current. Therefore during patterning with an ion beam, for example, a high helium gas pressure is required to maintain a sufficient amount of current.

For keeping the helium gas pressure in the order of $10^{-3}$ Torr or so under conditions where the vacuum degree outside the ion gun (i.e. in a bell jar) is $10^{-5}$ Torr, a great amount of helium gas must be supplied. However, increasing the amount of the supply helium gas causes a temperature rise in the emitter, which lowers the density of atoms (molecules) in the vicinity of the emitter and to consequently reduce the ion beam current density. Although the emitter is cooled as mentioned above to attain a high ion beam current density, there is a temperature limit of about 4° to 10° K. for cooling. Since it is customary to supply helium gas at room temperature into the ion beam apparatus, when the amount of the supply helium gas is increased as shown in FIG. 6, there is a temperature rise in the emitter 1. As a result, if the amount of the supplied helium gas is increased for the purpose of raising the gas pressure, the ion beam current density tends to become lower due to such temperature rise in the emitter to eventually cause a problem in that an expected increase of the probe current is not achieved.

Although the emitter temperature may be maintained at a sufficiently low point by enhancing the cooling capability for the increased amount of the supply helium gas, a disadvantage is unavoidable in that the procedure for such enhancement of the cooling capability requires that system be far more expensive than the present system.

Besides the above, the gas pressure between the emitter and the extractor is also raised with increased helium gas pressure, so that the problem of atmospheric electrical discharge becomes serious. Such atmospheric electrical discharge causes breakage of the emitter tip, which therefore fails to perform the proper function of an ion gun.

SUMMARY OF THE INVENTION

The present invention solves the problems mentioned. The object of the invention is to provide an improved ion gun which ensures a high ion current density by raising the pressure of an ion source in the vicinity of an emitter tip without the necessity of increasing the supply of helium gas, while not imparing the stability of emission of the ion beam.

In the ion gun of the ion beam apparatus according to the present invention, a gas to be ionized is supplied to the periphery of an emitter and a high voltage is applied between the emitter and an extractor so that the gas introduced in the vicinity of the emitter tip is ionized to generate an ion beam. A feature of the invention resides in a novel structure in which the gas is supplied to the periphery of the emitter via a nozzle surrounding the emitter, and the gas pressure between an opening in the nozzle and an opening in the extractor is maintained so as to be lower than the gas pressure at the emitter tip.

Due to the structure mentioned, a high luminance with a great ion current density can be attained by raising the ion source pressure in the vicinity of the emitter tip without increasing the supply of helium gas. Furthermore, the present invention prevents atmospheric electrical discharge by keeping the gas pressure low between the nozzle opening and the extractor opening despite increase of the gas pressure in the vicinity of the emitter tip.

BRIEF DESCRIPTION OF THE DRAWINGS

FIGS. 5 and 6 graphically explain the problems to be solved by the invention, in which FIG. 5 shows the relationship between a helium pressure and an ion current, and FIG. 6 shows the relationship between a helium pressure and an emitter temperature;

DESCRIPTION OF THE PREFERRED EMBODIMENTS

The ion beam apparatus of the present invention will be described in detail with reference to preferred embodiments shown in the accompanying drawings.

Figure 1:
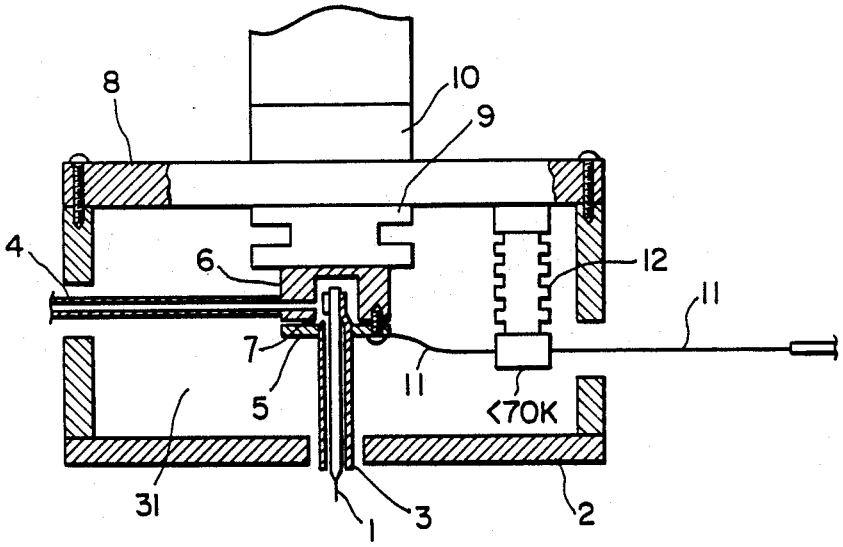
FIG. 1 is a sectional view of principal components in an ion beam apparatus embodying the present invention.

FIG. 1 is a sectional view of an ion beam apparatus embodiying the present invention, which has a needle emitter 1 mounted in a ceramic tube 3 with its tip protruding from the fore end of the ceramic tube 3 for a length of 0.2 mm or so. A gas (helium in this example) to be ionized is introduced via a gas supply pipe 4 and is jetted from the ceramic tube 3 toward the emitter tip. A gas jet orifice of the ceramic tube 3 surrounding the needle emitter 1 is located outside of an extractor 2 (0 V in this example). A support portion of the needle emitter 1 is formed integrally with a gas reservoir cover 5 at its base and is attached to the ceramic tube 3, so that the emitter can be replaced by merely changing the cover. So as to prevent leakage of the gas from a gap between a gas reservoir 6 of stainless steel and the gas reservoir cover 5, the gap is sealed with a metallic O-ring 7. The above components are covered with a heat radiation shield 8 and are cooled by the fore end 10 of a refrigerator through an insulator 9.

The ceramic tube 3 employed in this embodiment has an outer diameter of 0.5 mm, an inner diameter of 0.2 mm and a length of 20 mm. The tube may be composed of some other insulating material as well. The gas supply pipe 4 is composed of Teflon or ceramic material and is formed so as to minimize thermal inflow therethrough from the outside. The insulator 9 is composed of sapphire, and the heat radiation shield 8 is composed of copper and is plated with gold on its outer surfaces. The outer end of the refrigerator is composed of copper.

In the ion beam apparatus of the above-described structure, a high voltage is applied to the needle emitter 1 by way of a high-voltage introducing wire 11. In this embodiment, a voltage of 30 kV is applied. The degree of vacuum in the space surrounded by the extractor 2 and the heat radiation shield 8 can be maintained beyond $10^{-4}$ Torr (e.g. $10^{-5}$ Torr) since the flow rate of the gas jetted from the ceramic tube 3 is low. An exhaust pump having a capacity of 10 liters/sec is employed to keep the vacuum degree at $10^{-6}$ Torr or so in the bell jar. The number of gas atoms supplied to the tip of the needle emitter 1 can be maintained at a value adequate to obtain a sufficient ion current even when the degree of vacuum outside of the ion gun is below $10^{-4}$ Torr The extractor 2 and the emitter 1 are spaced apart from each other only by the ceramic tube 3 so that the functional effect of the extractor can be fully achieved electrically, whereby a high-intensity electric field region is formed at the emitter tip. The high-voltage introducing wire 11 of stainless steel is shaped to be extremely thin with a diameter of 0.03 mm and a length of 10 cm or so and is capable of minimizing thermal inflow from the outside within 1 mw. Since cooling is executed in the heat radiation shield through the ceramic insulator, the amount of inflow heat transmitted to the emitter support portion is further diminished.

Figure 2:
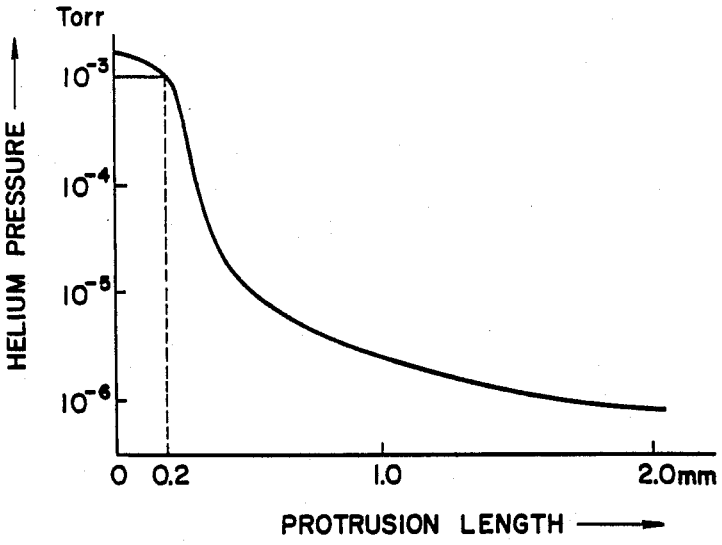
FIG. 2 graphically shows the relationship between the length of protrusion of an emitter tip from the fore end of a tubular member and the pressure of a gas ion source (helium)
Figure 3:
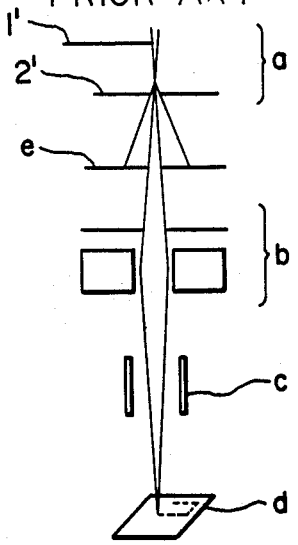
FIG. 3 PRIOR ART
FIG. 3 schematically shows the structure of an ion beam apparatus.

FIG. 2 graphically shows the relationship between the length of protrusion of the emitter tip from the fore end of the ceramic tube 3 and the helium pressure in the vicinity of the emitter tip. It is seen from this graph that the protrusion length needs to be less than 0.2 mm or so for obtaining a helium pressure above $10^{-3}$ Torr. However, if the tip of the emitter 1 is retracted even slightly from the fore end of the ceramic tube 3, ions generated at the emitter tip are deposited on the fore end of the ceramic tube 3 to consequently raise the potential. Then the generation of the ion beam is varied to eventually cause an undesired state where stable ion beam generation is not possible. It is therefore necessary to protrude the tip of the emitter 1 from the fore end of the ceramic tube 3 even though the protrusion length is extremely small.

The maximum protrusion length of the tip of the emitter 1 from the fore end of the ceramic tube 3 changes depending on the diameter of the ceramic tube 3. The relationship graphically shown in FIG. 2 represents merely an exemplary case where the ceramic tube 3 has an inner diameter of 0.2 mm. It is generally desired that the following condition be satisfied with respect to the protrusion length l and the diameter d of the ceramic tube 3:

$$0 < l \leqq 2d$$

As described above, the present invention is so constructed that the gas pressure at the emitter tip is maintained to be higher than $10^{-3}$ Torr or so, and the gas pressure between the nozzle opening and the extractor is maintained to be sufficiently low below $10^{-4}$ Torr.

Consequently, it becomes possible to realize a high luminance with a large ion beam current density while preventing discharge with atmospheric electricity between the nozzle opening and the extractor.

For accomplishing the above-described gas pressure structure, the present invention is constructed in a manner such that the positional relationship among the extractor, the emitter and the nozzle is retained as illustrated in FIG. 1, wherein the emitter is disposed to protrude from the nozzle, and both the nozzle and the emitter protrude from the extractor. Since the emitter thus protrudes from the space 31 which is surrounded with the heat radiation shield and the extractor, the gas pressure in such surrounded space 31 can be maintained effectively below $10^{-4}$ Torr and still the gas pressure at the emitter tip can be kept above $10^{-3}$ Torr. Furthermore, due to the arrangement where the nozzle 3 protrudes from the extractor opening and the vacuum degree in the bell jar is as high as $10^{-6}$ Torr, the gas pressure in the space formed between the nozzle end and the extractor opening can be maintained below $10^{-4}$ Torr. Consequently, the present invention is capable of preventing atmospheric electrical discharge between the emitter and the extractor while achieving a high luminance with a large ion current density of the ion beam. Since the gas to be ionized is supplied at a required minimum value to the emitter through the nozzle, the temperature rise in the emitter can be diminished.

The helium pressure in the vicinity of the emitter tip and in the chamber are at a ratio of 1000:1 and, as the latter pressure is so low, there is no danger of causing atmospheric electrically discharge in the electrostatic optical system.

Thus, due to the novel structure of the present invention where the gas pressure is high merely in the periphery of the emitter, it is not necessary to introduce a large amount of gas which minimizes the temperature rise in the emitter.

Figure 4:
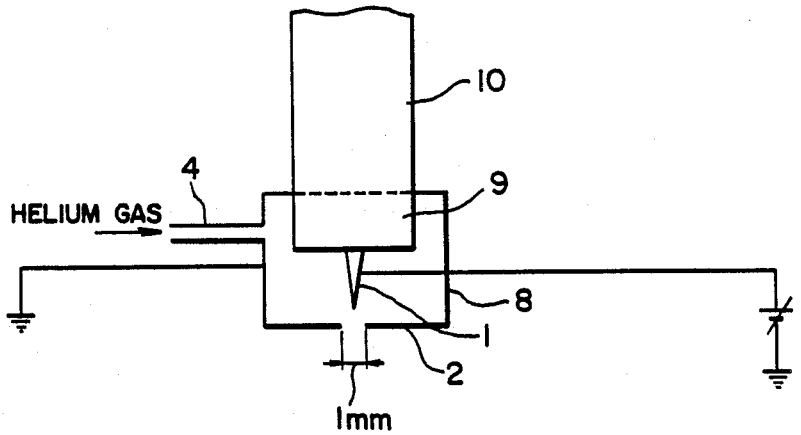
FIG. 4 PRIOR ART
FIG. 4 is a sectional view of a conventional ion gun which is one of principal components.
Figure 5:
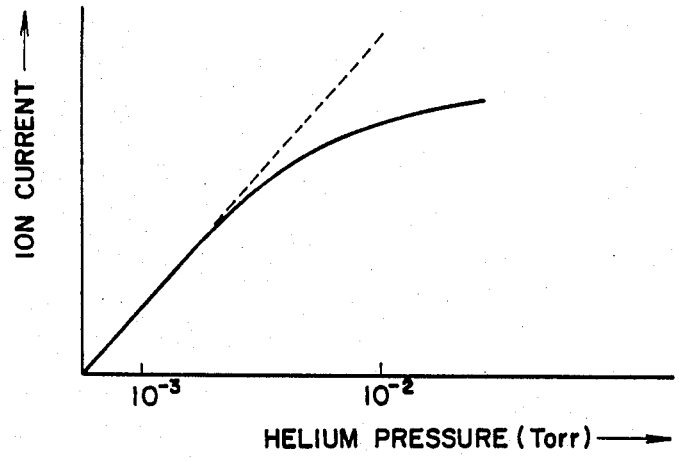
Figure 6:
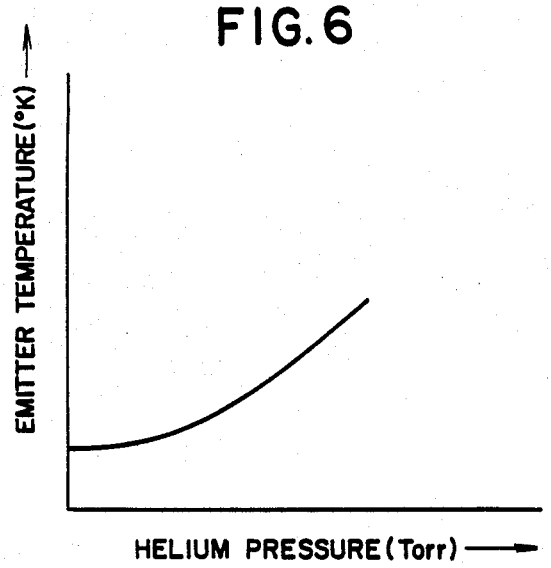
Figure 7:
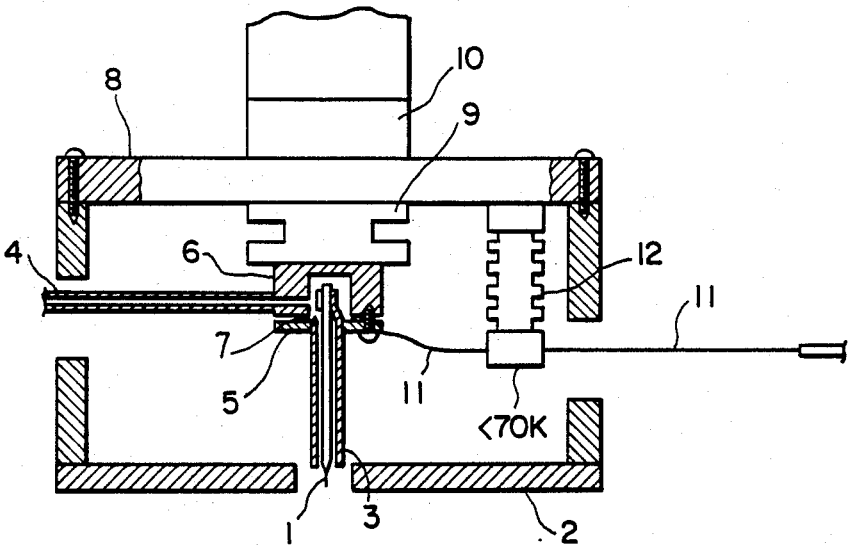
FIGS. 7, 9 and 12 show other embodiments of the invention, respectively.
Figure 8:
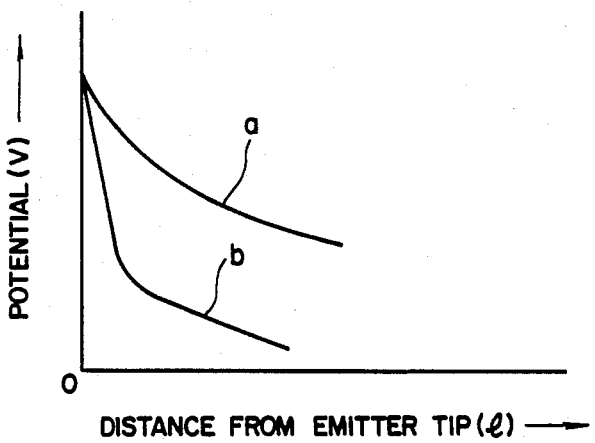
FIGS. 8 and 11 graphically show the effects attained in the other embodiments.

Another preferred embodiment of the present invention is shown in FIG. 7, wherein the positional relationship among the extractor, emitter and nozzle is different from FIG. 1. In this embodiment, the nozzle opening and the emitter tip are located in the extractor opening. With respect to the gas pressures, the same relationship as in FIG. 1 is obtained in this embodiment, and particularly as plotted in FIG. 8, the potential gradient (b) relative to the distance from the emitter tip becomes steeper than the potential gradient (a) in the conventional structure of FIG. 4, so that the effective application of potentials to the extractor and the emitter can be applied even if the potential difference is small.

The reason for such small potential gradient in the conventional structure is due to the fact that some potential leakage occurs at the base portion of the emitter. Accordingly, it is possible in the structure of FIG. 1 as well to reduce such potential leakage in comparison to the conventional structure, so that the potential gradient becomes steeper than that of the prior art.

Figure 9:
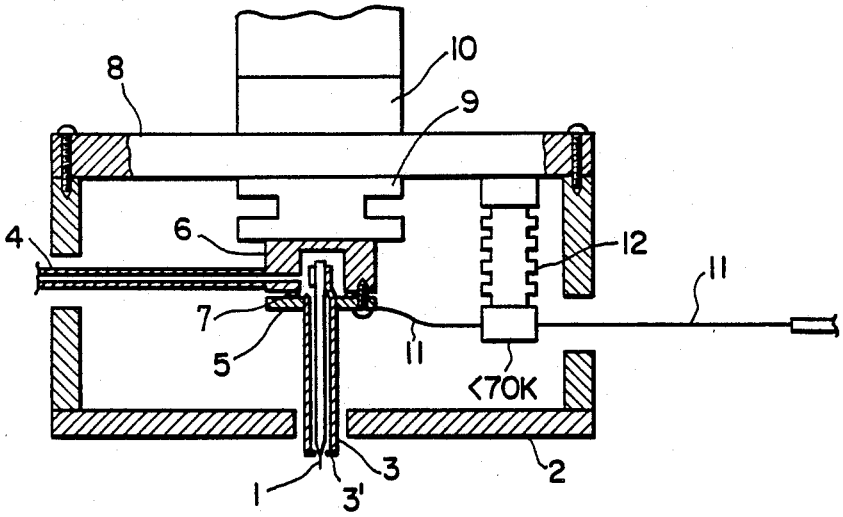
Figure 10:
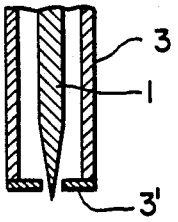
FIG. 10 illustrates principal components in FIG. 9.

FIG. 9 shows a further preferred embodiment of the present invention where an adaptor 3' is provided in the nozzle opening, and FIG. 10 illustrates the principal elements of FIG. 9.

Figure 11:
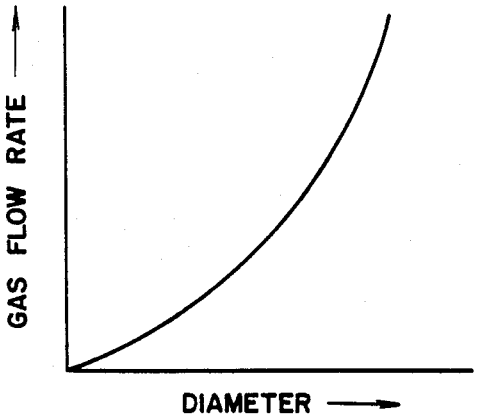

If the diameter of the nozzle opening is enlarged, the gas flow rate is naturally increased as shown in FIG. 11. Therefore the adaptor 3' is additionally furnished for decreasing the diameter of the nozzle opening to obtain effective use of the gas.

Figure 12:
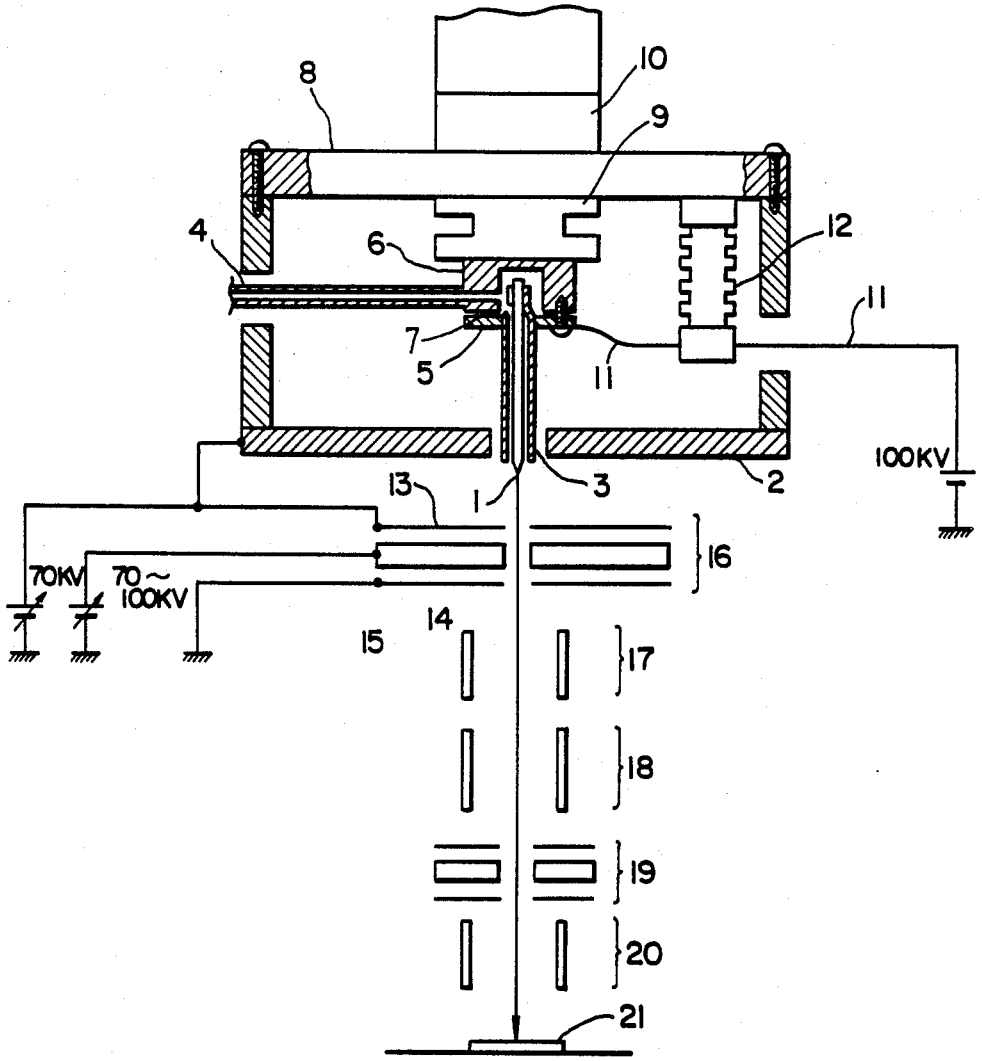

FIG. 12 shows an even further preferred embodiment of the present invention which includes a condenser lens 16 consisting of electrodes 13, 14 and 15 for focusing an ion beam. The aperture is eliminated in this embodiment, and the emitter is positioned in the proximity of the condenser lens so that the ion beam emitted over a wide angular range can be focused. In this embodiment, the focusing electrode 13 is proximate to the extractor and serves also as an aperture. Further shown are a filament electrode 17, a blanking electrode 18, an objective condenser electrode 19, and a polarizing electrode 20.

In comparison with the ion gun structure of FIG. 1 where the potential of the extractor 2 and that of the focusing electrode 13 proximate thereto are different from each other, this embodiment is so formed so that the potentials are equal. Accordingly, the problem is solved where the emitter which is integral with the extractor is inclined toward the condenser lens for optical axis alignment, and the electrical field distribution formed by the condenser lens is harmfully affected to consequently deteriorate the ion-beam focusing capability.

Although in the above embodiments the nozzle is composed of an insulating material such as ceramic, it may also be formed of a suitable conductive material such as a metal without being limited to insulating material.

In the structure where the nozzle is composed of an insulating material, there is attained an advantageous effect to prevent atmospheric electrical discharge that may otherwise be caused between the extractor and the emitter. However, due to the insulating material of the nozzle, charge-up occurs during generation of the ion beam so that atmospheric electrical discharge is likely to be induced and there also exists a danger of varying the ion beam orbit. In view of such problems, therefore, the nozzle may be composed of a conductive material to attain effective prevention of such charge-up although the insulation effect between the extractor and the emitter is lost.

While exemplary embodiments of the present invention have been described, it will be apparent to those skilled in the art that various minor modifications may be made therein without departing from the spirit and scope of the invention as claimed.

We claim as our invention:

1. An ion beam apparatus with an ion gun disposed in a bell jar under a predetermined air pressure for generating an ion beam, said ion gun comprising, an emitter, an extractor spaced apart therefrom and having a predetermined potential different with respect to said emitter, and a tubular nozzle surrounding said emitter for supplying a gas which is to be ionized to the tip of said emitter, wherein the tip of said emitter protrudes from an opening of said nozzle, and the gas pressure between the opening of said nozzle and said extractor is maintained so as to be higher than the air pressure in said bell jar and to be lower than the gas pressure at the tip of said emitter.

2. An ion gun for generating an ion beam, comprising an emitter, an extractor spaced apart therefrom and having a predetermined potential difference with respect to said emitter, and a tubular nozzle surrounding said emitter for supplying a gas, which is to be ionized to the tip of said emitter, wherein the tip of said emitter protrudes from an opening of said nozzle, and both the tip of said emitter and the opening of said nozzle protrude from the opening of said extractor.

3. An ion gun for generating an ion beam, comprising an emitter, and extractor spaced apart therefrom and having a predetermined potential difference with respect to said emitter, and a tubular nozzle surrounding said emitter for supplying a gas which is to be ionized to the tip of said emitter, wherein the tip of said emitter proturudes from an opening of said nozzle, and both the tip of said emitter and the opening of said nozzle are positioned within the confines thickness of the opening of said extractor.

4. An ion gun for generating an ion beam, comprising an emitter, an extractor spaced apart therefrom and having a predetermined potential difference with respect to said emitter, and a tubular nozzle surrounding said emitter for supplying a gas which is to be ionized to the tip of said emitter, wherein the tip of said emitter protrudes from the opening of said nozzle, the opening of said nozzle is positioned within the confines of the opening of said extractor, and the tip of said emitter protrudes from the opening of said extractor.

5. The ion gun as defined in claim 1 or 2 or 3 or 4, wherein the distance between the tip of said emitter and the fore end of said nozzle is greater than zero and smaller than twice the inner diameter of the opening of said nozzle.

6. The ion gun as defined in claim 1 or 2 or 3 or 4, wherein said nozzle is equipped with an adaptor for reducing the area of the opening of said nozzle.

7. The ion gun as defined in claim 1 or 2 or 3 or 4, further having a condenser lens consisting of a plurality of focusing electrodes to focus an ion beam, wherein the extractor-side focusing electrode of said condenser lens has the same potential as that of said extractor.

8. The ion gun as defined in claim 1 or 2 or 3 or 4, wherein said nozzle is composed of an electrical conductive material.

9. The ion gun as defined in claim 1 or 2 or 3 or 4, wherein said nozzle is composed of an electrical insulating material.

* * * * *